US010260408B2

(12) United States Patent
Muramatsu et al.

(10) Patent No.: US 10,260,408 B2
(45) Date of Patent: Apr. 16, 2019

(54) OUTBOARD MOTOR WITH BUILT IN FUEL TANK

(71) Applicant: SUZUKI MOTOR CORPORATION, Hamamatsu-shi, Shizuoka (JP)

(72) Inventors: Go Muramatsu, Hamamatsu (JP); Tadaaki Morikami, Hamamatsu (JP); Yasuomi Ishihara, Hamamatsu (JP); Hideto Nakamura, Hamamatsu (JP); Yoshihiro Horitani, Hamamatsu (JP)

(73) Assignee: SUZUKI MOTOR CORPORATION, Hamamatsu-shi (JP)

( * ) Notice: Subject to any disclaimer, the term of this patent is extended or adjusted under 35 U.S.C. 154(b) by 0 days.

(21) Appl. No.: 15/971,172

(22) Filed: May 4, 2018

(65) Prior Publication Data

US 2018/0252154 A1 Sep. 6, 2018

Related U.S. Application Data

(63) Continuation of application No. 15/340,009, filed on Nov. 1, 2016, now abandoned.

(30) Foreign Application Priority Data

Nov. 4, 2015 (JP) ..... 2015-216920

(51) Int. Cl.
*F02B 61/04* (2006.01)
*F01L 1/047* (2006.01)
(Continued)

(52) U.S. Cl.
CPC ..... *F02B 61/045* (2013.01); *F01M 1/02* (2013.01); *F02B 75/007* (2013.01); *F02M 37/0047* (2013.01); *F01L 2001/0475* (2013.01); *F01L 2001/054* (2013.01); *F01L 2250/06* (2013.01); *F01L 2810/02* (2013.01); *F01M 2001/0261* (2013.01); *F01M 2001/064* (2013.01); *F01M 2011/026* (2013.01)

(58) Field of Classification Search
CPC .. F02B 61/045; F02B 2075/027; F02B 75/16; F02M 37/0047; F01M 1/02
See application file for complete search history.

(56) References Cited

U.S. PATENT DOCUMENTS 2,256,831 A * 9/1941 Karey ..... B63H 20/10 123/195 P
2,346,148 A * 4/1944 Bosma ..... F02B 61/04 123/195 P
(Continued)

FOREIGN PATENT DOCUMENTS

EP 1 316 500 6/2003
JP 03074297 3/1991
(Continued)

*Primary Examiner* — Mahmoud Gimie
*Assistant Examiner* — John Zaleskas
(74) *Attorney, Agent, or Firm* — Cozen O'Connor

(57) ABSTRACT

An axis line of a cylinder and a cylinder head of a four-stroke engine is disposed inclining to one side in a lateral direction with respect to a center line extending in a front-rear direction of the outboard motor from a top view, and a fuel tank is disposed on a side portion of the cylinder and the cylinder head in another side in the lateral direction with respect to the center line.

3 Claims, 7 Drawing Sheets

(51) Int. Cl.

| | |
|---|---|
| ***F01M 1/02*** | (2006.01) |
| ***F02B 75/02*** | (2006.01) |
| ***F02M 37/00*** | (2006.01) |
| ***F02B 75/00*** | (2006.01) |
| *F01M 1/06* | (2006.01) |
| *F01M 11/02* | (2006.01) |

(56) References Cited

U.S. PATENT DOCUMENTS 2,351,050 A * 6/1944 Karey ..... B63H 20/245 123/195 P
2,458,051 A * 1/1949 Bosma ..... F01M 1/12 123/196 W
2,501,470 A * 3/1950 Krueger ..... B63H 20/00 123/195 P
4,692,123 A * 9/1987 Tada ..... F02B 61/045 123/195 P
5,049,100 A * 9/1991 Yamamoto ..... F02B 61/045 440/77
5,309,877 A * 5/1994 Shigedomi ..... F02B 61/045 123/192.2
5,383,440 A * 1/1995 Koishikawa ..... F01M 13/022 123/196 W
5,443,044 A * 8/1995 VanRens ..... F02B 61/045 123/195 HC
5,669,358 A * 9/1997 Osakabe ..... F02B 61/045 123/196 W
5,806,311 A * 9/1998 Okamoto ..... F01N 3/046 60/323
5,855,197 A * 1/1999 Kato ..... F02B 61/045 123/509
5,865,160 A * 2/1999 Kato ..... F01B 9/06 123/514
6,058,894 A * 5/2000 Kobayashi ..... F02B 61/045 123/197.4
6,067,951 A * 5/2000 Kitajima ..... F01L 1/047 123/196 R
6,095,877 A * 8/2000 Kawamukai ..... F02B 61/045 440/77
6,132,275 A * 10/2000 Tanaka ..... F01M 11/04 123/196 R
6,182,631 B1 * 2/2001 Kitajima ..... F01L 1/047 123/195 HC
6,183,323 B1 * 2/2001 Tanaka ..... F01P 1/02 440/77
6,305,340 B1 * 10/2001 Furuya ..... F02B 63/02 123/195 AC
6,357,401 B1 * 3/2002 Moriyama ..... F01M 9/08 123/195 R
2003/0054709 A1 * 3/2003 Yomo ..... F02B 61/045 440/77
2017/0183993 A1 * 6/2017 Ishihara ..... B63H 20/001
2017/0191388 A1 * 7/2017 Ishihara ..... F01M 11/02

FOREIGN PATENT DOCUMENTS

JP 03074297 A * 3/1991 ..... F02B 61/045
JP 10016887 1/1998
JP 10016887 A * 1/1998
JP 2000-297655 10/2000
JP 2000297655 A * 10/2000 ..... F02B 61/045
JP 2001-107800 4/2001
JP 2001-115889 4/2001
JP 2001107800 A * 4/2001 ..... F02B 61/045
JP 2001115889 A * 4/2001 ..... F02B 61/045
JP 2001-182550 7/2001
JP 2001182550 A * 7/2001 ..... F02B 61/045
JP 2003-097289 4/2003
JP 2003097289 A * 4/2003
JP 2003 201 840 A 7/2003
JP 2006-291770 10/2006
JP 2006291770 A * 10/2006
JP 4736512 7/2011

* cited by examiner

OUTBOARD MOTOR WITH BUILT IN FUEL TANK

CROSS-REFERENCE TO RELATED APPLICATIONS

This application is a continuation of U.S. application Ser. No. 15/340,009 filed Nov. 1, 2016 which claims the priority of the Japanese Patent Application No. 2015-216920 filed on Nov. 4, 2015, the entire contents of which are incorporated herein by reference.

BACKGROUND OF THE INVENTION

Field of the Invention

The present invention relates to an outboard motor that includes an internal combustion engine as a power source, especially includes a fuel tank to retain fuel to an engine as the internal combustion engine.

Description of the Related Art

For example, Patent Document 1 and Patent Document 2 disclose outboard motors with built in fuel tank that include a four-stroke engine, an engine cover, and a fuel tank. The four-stroke engine includes a crankshaft disposed in an approximately vertical direction, and includes a cylinder extending rearward perpendicular to the crankshaft from a side view and a cylinder head where a combustion chamber matching the cylinder is disposed. The engine cover covers a periphery of the four-stroke engine, and is dividable into an upper cover and a lower cover in a vertical direction. The fuel tank is housed in the engine cover, and includes a fuel inlet where the upper portion is covered with a fuel cap projecting above the upper cover.

In Patent Document 2, the fuel tank is disposed on a space, ahead of the engine opposite to the rear portion of the engine, where the cylinder head including an intake port is disposed. Then, a fuel pipe of the outboard motor passes through a side portion of the engine from a bottom portion of the fuel tank to be coupled to an injector disposed on the intake port of the cylinder head.

Patent Document 1: Japanese Laid-open Patent Publication No. 2003-701840.

Patent Document 2: Japanese Patent No. 4736512.

In Patent Document 1, the fuel tank is disposed on a space above the cylinder. In this configuration, a shallow depth of the fuel tank prevents a high-pressure fuel pump from being disposed in the fuel tank. Further, a vertically flat shape of the fuel tank causes the fuel in the fuel tank to easily incline to an inclining side when the outboard motor is inclined. Then, a suction port of the high-pressure fuel pump is exposed from a fuel liquid surface to suction air. This affects the engine operation.

In Patent Document 2, in the middle of the fuel pipe that passes through the side portion of the engine from the bottom portion of the fuel tank to be coupled to the injector disposed on the intake port of the cylinder head, the high-pressure fuel pump is interposed on a low portion position.

The high-pressure fuel pump requires to be disposed on a low position compared with an oil surface in the fuel tank in order to use the fuel in the fuel tank without leaving.

Further, for improving starting ability of a fuel injection engine with the injector, it is important how quickly the fuel pipe from the high-pressure fuel pump to the injector can be filled with the fuel to accurately inject the fuel. In Patent Document 2, a long pipe coupling the high-pressure fuel pump to the injector takes a long time to fill the fuel pipe with the fuel. This decreases the starting ability of the engine. Especially, a battery-less engine without a battery fails to preliminarily operate the high-pressure fuel pump to apply pressure to the fuel like an engine with a battery. Therefore, operating the high-pressure fuel pump by a recoil starter only with an electric power of an electric generator disposed on the crankshaft requires the recoil starter to be repeatedly rotated. This increases a load of a user.

SUMMARY OF THE INVENTION

The present invention has been made in view of the above-described problems, and it is an object of the present invention to invent an effective positional relationship of a fuel tank and provide an outboard motor with built in fuel tank that achieves such as a proper and effective fuel supply.

An outboard motor with built in fuel tank of the present invention includes a four-stroke engine, an engine cover, and a fuel tank. The four-stroke engine includes a crankshaft disposed in an approximately vertical direction, a cylinder extending rearward perpendicular to the crankshaft from a side view, and a cylinder head including a combustion chamber that matches the cylinder. The engine cover covers a periphery of the four-stroke engine, and is dividable into an upper cover and a lower cover in a vertical direction. The fuel tank is housed in the engine cover, and includes a fuel inlet on an upper portion of the fuel tank, the fuel inlet being covered with a fuel cap. An axis line of the cylinder and the cylinder head of the four-stroke engine is disposed inclining to one side in a lateral direction with respect to a center line that extends in a front-rear direction of the outboard motor from a top view. The fuel tank is disposed on a side portion of the cylinder and the cylinder head in another side in the lateral direction with respect to the center line.

In the outboard motor with built in fuel tank of the present invention, while an exhaust port is disposed on an inferior surface of the cylinder head to be coupled with an exhaust passage below, an intake port is disposed on a top surface of the cylinder head such that a throttle body coupled to the intake port is disposed above the cylinder head.

In the outboard motor with built in fuel tank of the present invention, the four-stroke engine includes a fuel injector near the intake port of the cylinder head. An in-tank type high-pressure fuel pump is internally disposed on the fuel tank, and the high-pressure fuel pump and the fuel injector are coupled to one another via a fuel pipe.

In the outboard motor with built in fuel tank of the present invention, the four-stroke engine includes an OHV valve mechanism, and a camshaft of the valve mechanism is disposed in a crankcase on one side in a lateral direction where the cylinder and the cylinder head are disposed to be inclined.

In the outboard motor with built in fuel tank of the present invention, the four-stroke engine employs a forced lubrication system that includes an oil pump, and an oil filter that cleans lubricating oil supplied from the oil pump is disposed on a side portion of a base end of the cylinder in one side in a lateral direction of the cylinder and the cylinder head.

DETAILED DESCRIPTION OF THE PREFERRED EMBODIMENTS

The following describes preferred embodiments of an outboard motor with built in fuel tank according to the present invention based on the drawings.

Figure 1:
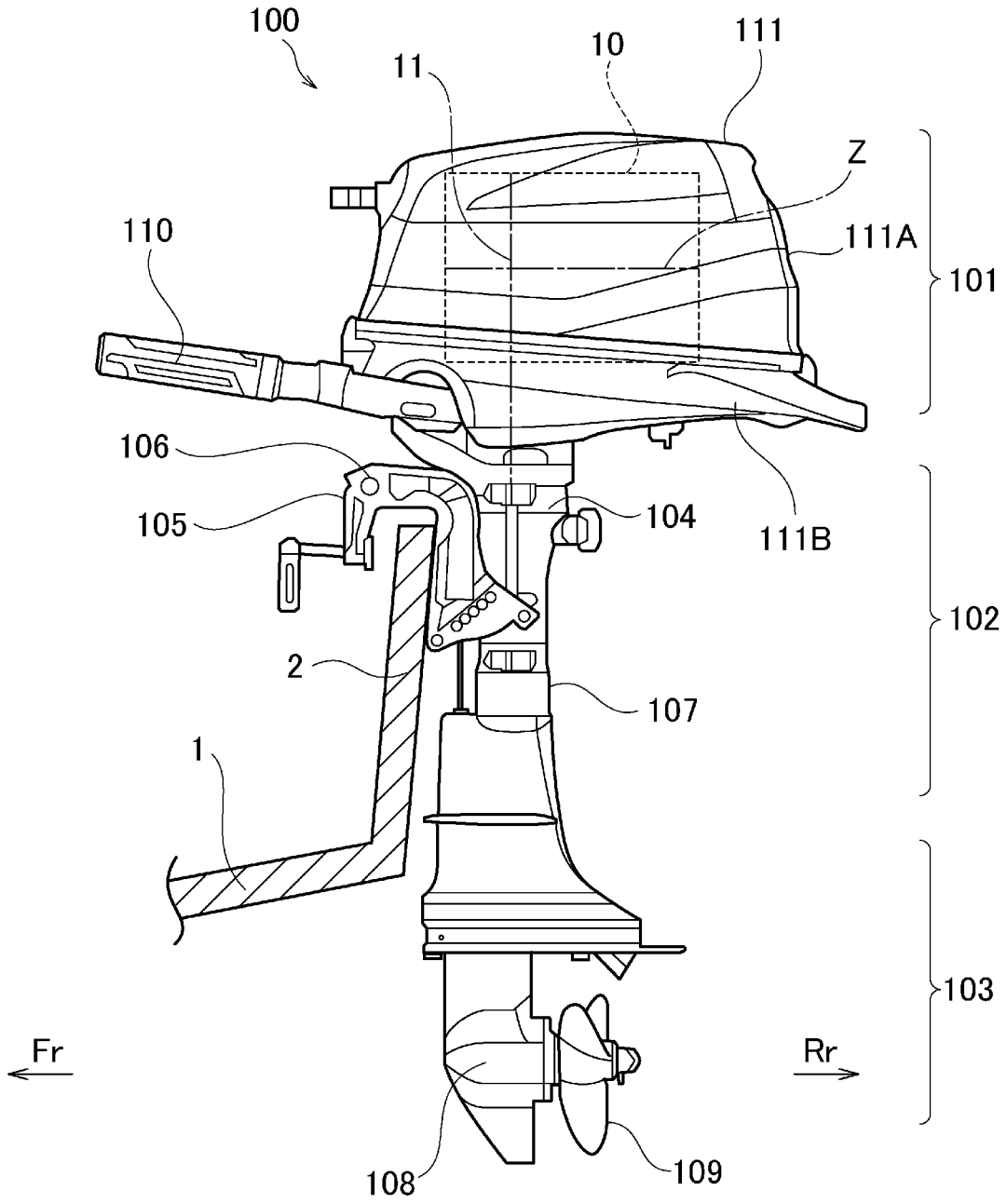
FIG. 1 is a left side view illustrating an exemplary schematic configuration of an outboard motor according to the present invention.

FIG. 1 is a left side view illustrating an exemplary schematic configuration of an outboard motor 100 as an application example of the present invention. In this example, as illustrated in FIG. 1, the outboard motor 100 is secured to a rear plate 2 of a ship 1 on a front portion side of the outboard motor 100. The outboard motor 100 includes an engine 10 according to the present invention. In the following description, in each drawing, an arrow Fr and an arrow Rr respectively indicate forward and rearward of the outboard motor 100 or the engine 10, and an arrow R and an arrow L respectively indicate the right side and the left side of the side portion of the outboard motor 100, as necessary.

In an overall configuration of the outboard motor 100, an upper unit (or power unit) 101, a middle unit 102 and a lower unit 103 are configured to be located from an upper portion to a lower portion in the order. The outboard motor 100 includes the engine 10 in the upper unit 101 so as to vertically include to support the engine 10 such that a crankshaft 11 of the engine 10 is arranged in a vertical direction as described below. For the engine 10, a single cylinder engine is typically applicable. The middle unit 102 is horizontally turnably supported around a support shaft disposed on a swivel bracket 104. The swivel bracket 104 includes a pair of clamp brackets 105 (suspension device) on both right and left sides, and both clamp brackets 105 are coupled to one another via a tilt shaft 106 disposed in a lateral direction. The clamp brackets 105 are secured to the rear plate 2 of the ship 1, and the entire outboard motor 100 is supported rotatably in the vertical direction around the tilt shaft 106 via the swivel bracket 104.

The middle unit 102, more specifically a drive shaft housing 107, includes a drive shaft penetratingly disposed in the vertical direction to be coupled to a lower end portion of the crankshaft 11. A driving force of the drive shaft is transmitted to a propeller shaft in a gear case 108 of the lower unit 103. The propeller shaft includes a propeller 109 on a rear end, and the power of the engine 10 passes through a power transmission path, which is constituted of the crankshaft, the drive shaft, the propeller shaft, and similar component, to be finally transmitted to the propeller 109. Then, the propeller 109 can be rotatably driven. A steering wheel 110 (steering gear) is configured to be appropriately turned to steer the propeller 109 in a desired angle.

In the above-described case, the upper unit 101 is covered with an exterior cover 111. The exterior cover 111 (engine cover) includes an upper cover 111A that covers around an upper portion of the upper unit 101, and a lower cover 111B that covers around a lower portion of the upper unit 101. The upper cover 111A and the lower cover 111B are integrally joined together to form an appearance form of the exterior cover 111 in such as an approximately egg shape or lemon shape as a whole.

Figure 2:
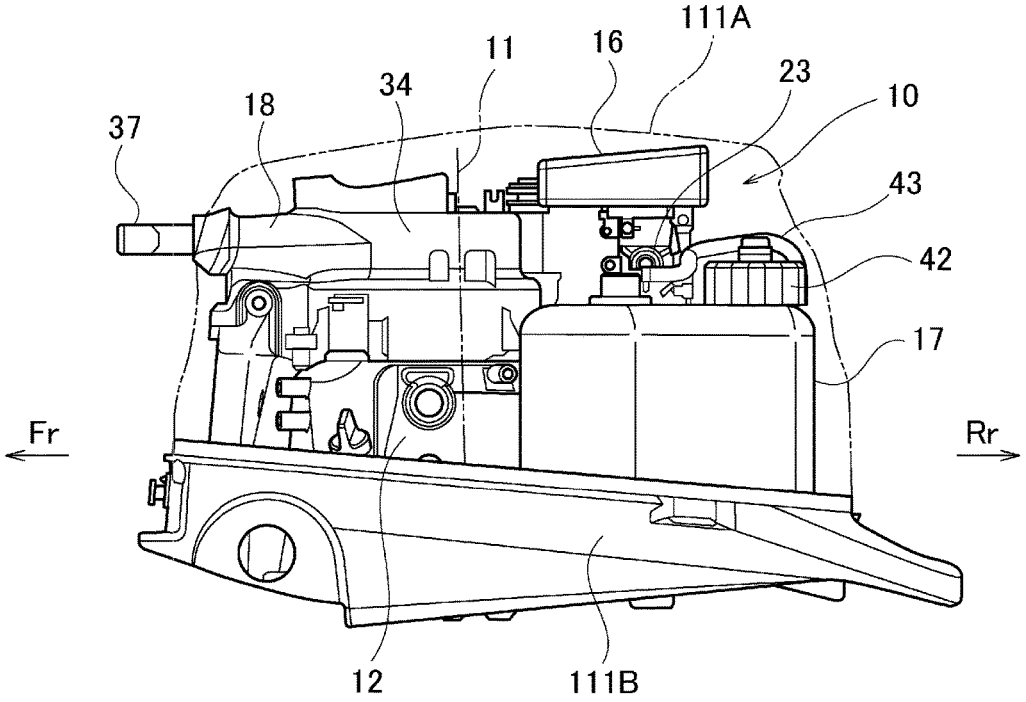
FIG. 2 is a left side view illustrating around an engine when an exterior cover is removed in the outboard motor according to the present invention.
Figure 3:
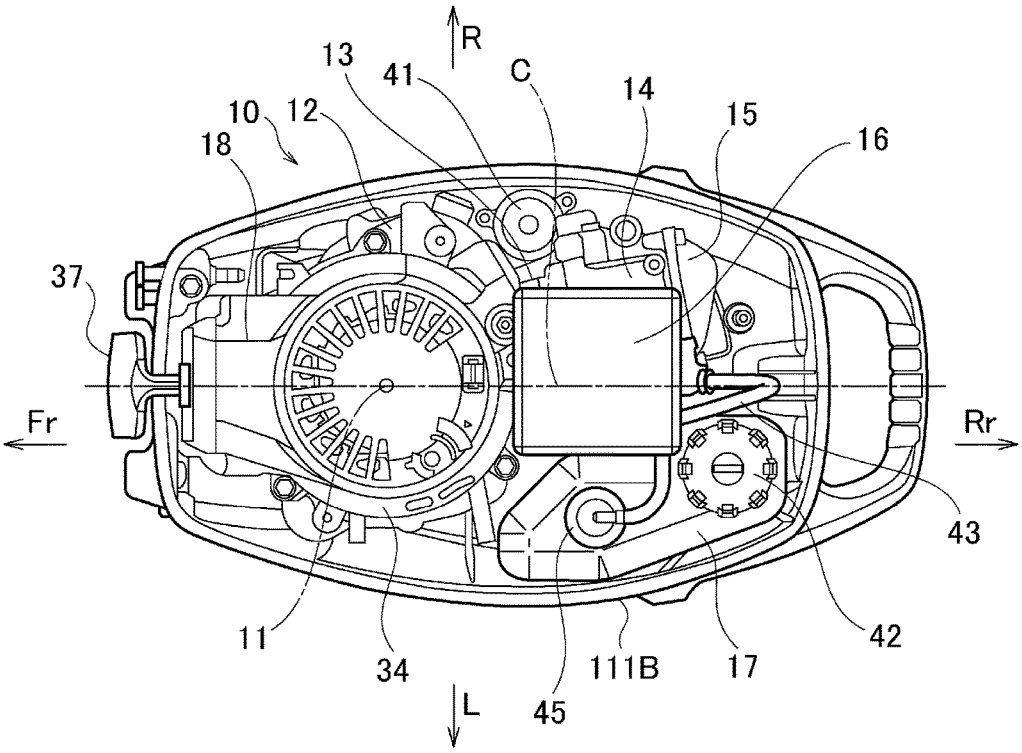
FIG. 3 is a top view illustrating around the engine when the exterior cover is removed in the outboard motor according to the present invention.
Figure 4:
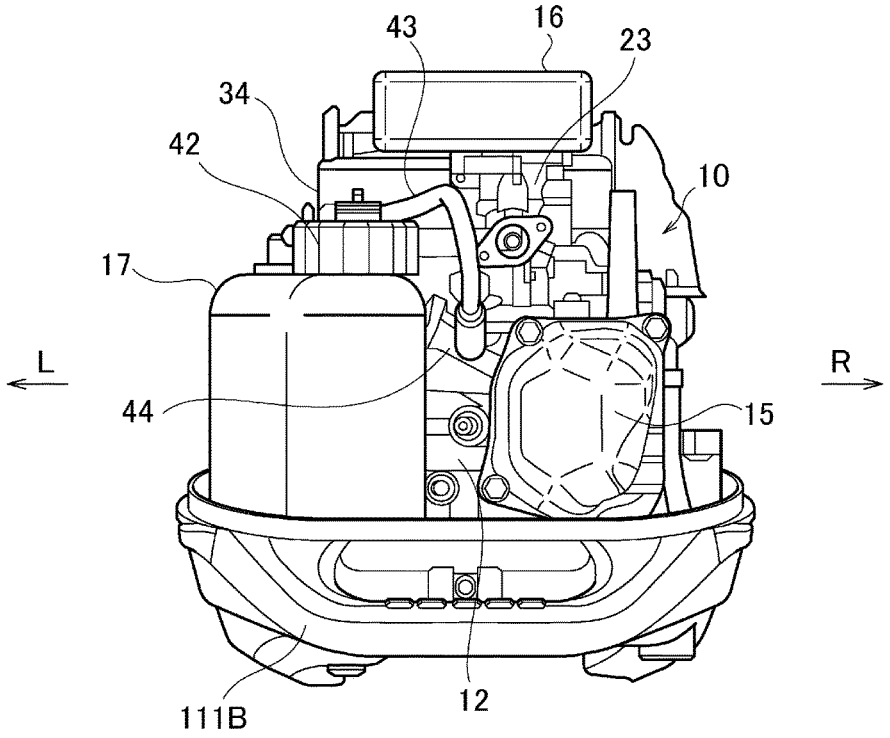
FIG. 4 is a front view illustrating around the engine viewed from a cylinder head side when the exterior cover is removed in the outboard motor according to the present invention.

Next, a description will be given of the engine 10 according to the present invention. FIG. 2 to FIG. 4 illustrate around the engine 10 in the upper unit 101 when the upper cover 111A is removed. FIG. 2 is a left side view, FIG. 3 is a top view, and FIG. 4 is a front view viewed from a cylinder head side of the engine 10. In this example, an Over Head Valve (OHV) engine is employed as the engine 10, and the engine 10 is vertically disposed and supported in the upper unit 101 via an engine holder such that the crankshaft 11 of the engine 10 is arranged in the vertical direction. Thus supported crankshaft 11 is disposed on a center line C of the outboard motor 100 extending in a front-rear direction (that is, on a center in a right and left the direction), as illustrated in such as FIG. 3. The engine 10 includes an engine case 12 (crankcase, see FIG. 2) that houses to support the crankshaft 11, a cylinder block or cylinder) 13, a cylinder head 14, and a cylinder head cover 15. With referring to FIG. 5, the cylinder block 13, the cylinder head 14 and the cylinder head cover 15 are integrally joined in the order on the back of the engine case 12. When the outboard motor 100 is equipped to the ship 1 as illustrated in FIG. 1, a cylinder axis line Z orients rearward in a horizontal direction perpendicular to the vertical direction.

Around the engine 10, an air intake system, a fuel supply device, an exhaust system, a cooling system, a lubricating system, and further, a control system (ECU; Engine Control Unit) are disposed. The air intake system is configured to include an air cleaner box 16, and includes an intake device that supplies intake air to the engine 10. The fuel supply device is configured to include the fuel tank 17 to supply the fuel. The exhaust system discharges exhaust gas after combustion from the engine 10. The cooling system cools the engine 10. The lubricating system lubricates movable parts of the engine 10. The control system is configured to include a recoil starter 18, incidentally includes a plurality of function systems and auxiliary machines such as an engine starting device that starts the engine 10, and controls the operation of the function systems and the auxiliary machines. The control by the control system causes the plurality of the function systems to collaborate with such as the above-described auxiliary machines. This performs a smooth operation of the entire engine unit. The auxiliary machines are housed in the exterior cover 111 with the engine 10.

Here, a main body of the engine 10 will be firstly described. In this embodiment, the engine case 12 is divided into an upper engine case and a lower engine case each of which integrally includes the cylinder block 13. The crankshaft 11 is rotatably supported in a crank chamber by bearings disposed in the upper engine case and the lower engine case. The bearings include such as sliding bearings.

Figure 6:
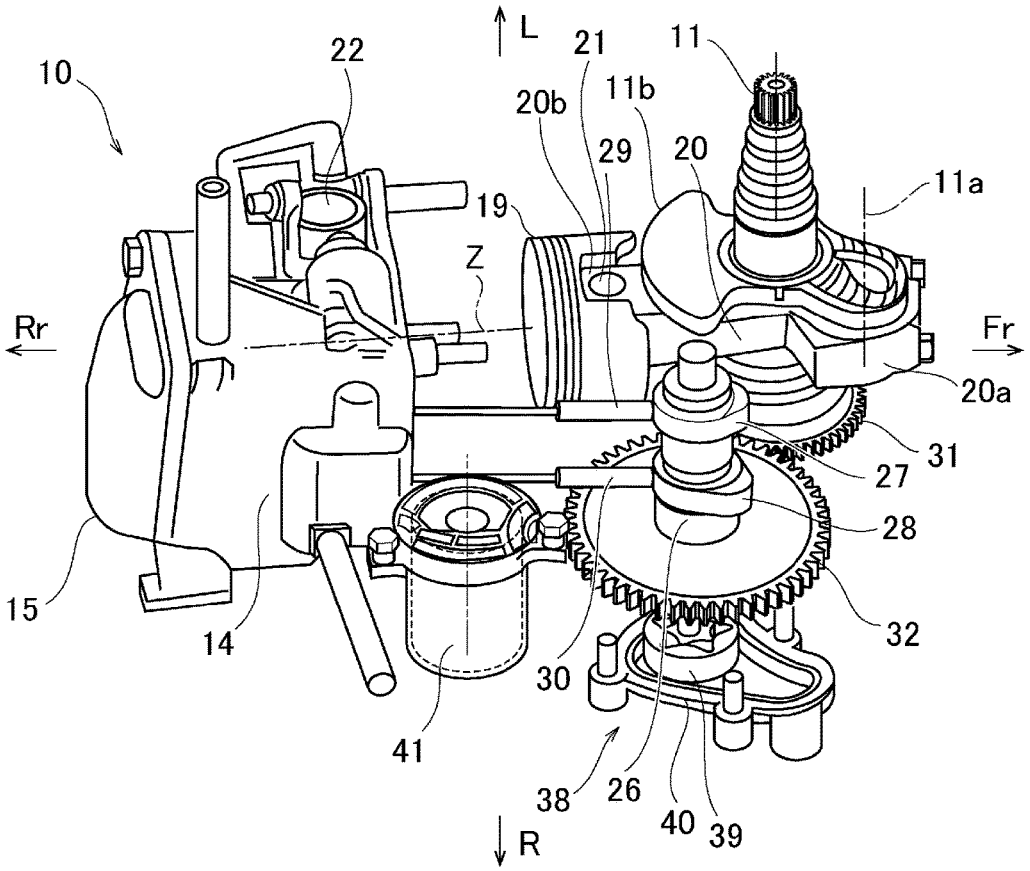
FIG. 6 is a perspective view illustrating such as a valve mechanism of the engine of the outboard motor according to the present invention.

With referring to FIG. 6, the cylinder block 13 includes a cylinder bore that houses a piston 19 reciprocatably along a direction of the cylinder axis line Z. The crankshaft 11 and the piston 19 are coupled to one another via a connecting rod 20. The connecting rod 20 includes a large end portion 20*a* coupled to a crank pin 11*a* of the crankshaft 11, and a small end portion 20*b* coupled to a piston pin 21 of the piston 19. The reciprocation of the piston 19 in the direction of the cylinder axis line Z in the cylinder bore of the cylinder block 13 rotatably drives the crankshaft 11 via the connecting rod 20. On the crankshaft 11, a crank web 11*b* that integrally rotates with the crankshaft 11 is attached.

Figure 5:
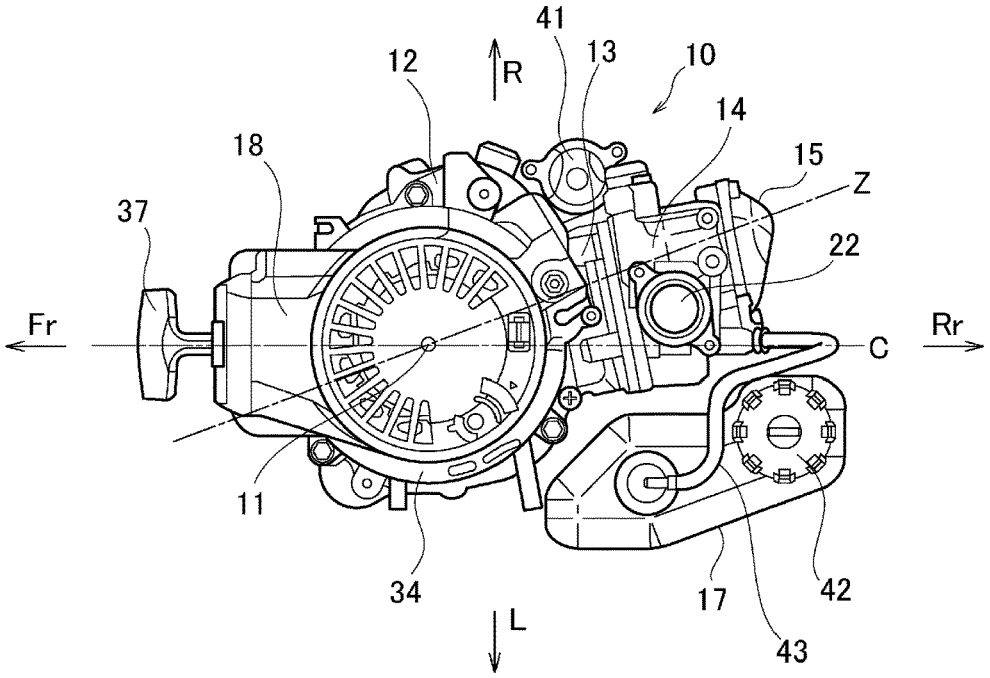
FIG. 5 is a top view illustrating around the engine of the outboard motor according to the present invention.
Figure 7:
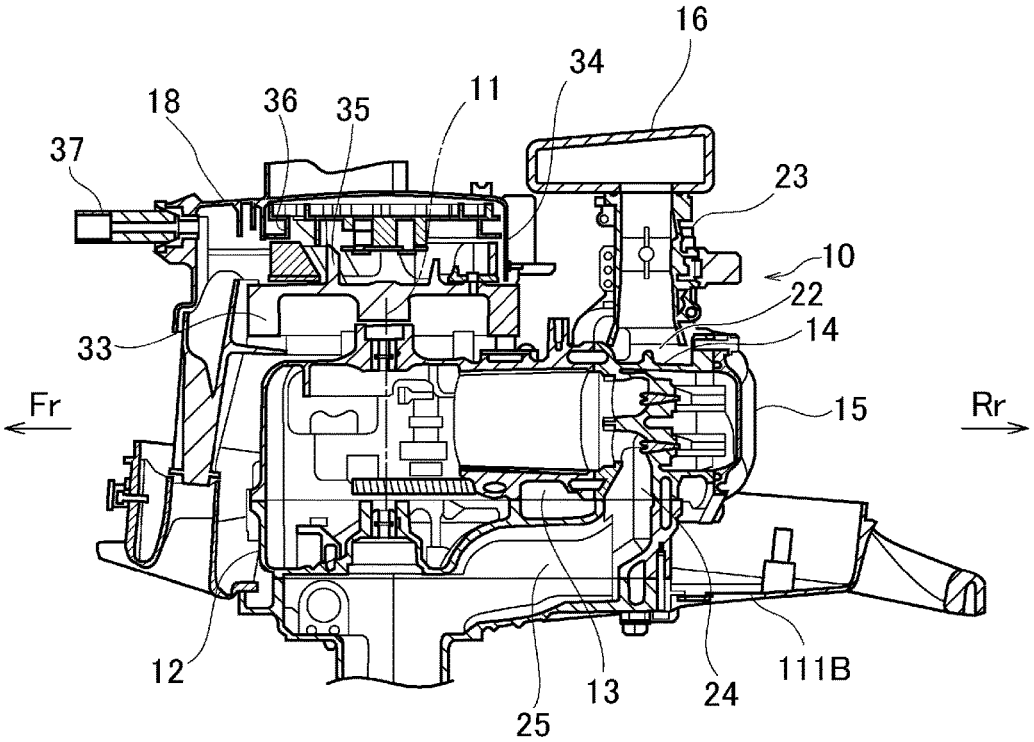
FIG. 7 is a cross-sectional view illustrating such as an air intake system and an exhaust system of the engine of the outboard motor according to the present invention.

In the air intake system and the exhaust system of the engine 10, the cylinder head 14 includes a combustion chamber (not illustrated in detail), and as illustrated in FIG. 5 and FIG. 6, an intake port 22 communicated with the combustion chamber upwardly opens on a top surface of the cylinder head 14. As illustrated in FIG. 7, above the cylinder head 14, a throttle body 23 is coupled to the upper portion of the intake port 22, and the air cleaner box 16 supplies intake air to the throttle body 23. The air cleaner box 16, the throttle body 23, and similar part constitute the intake device, and the intake device collaborates with the fuel supply device to supply air-fuel mixture to the combustion chamber of the engine 10 via the intake port 22.

As illustrated in FIG. 7, in the cylinder head 14, an exhaust port 24 is communicated with the combustion chamber. The exhaust port 24 is coupled to an exhaust passage 25 on the lower side of the engine case 12. A combustion gas generated in the combustion chamber is exhausted as an exhaust gas passing through the exhaust passage 25.

In a valve operating device, between the combustion chamber, and the intake port 22 and the exhaust port 24 are respectively opened and closed by an intake valve and an exhaust valve at a predetermined timing. That is, the intake valve and the exhaust valve cause the combustion chamber to be communicated with the intake port 22 and the exhaust port, or obstruct between the combustion chamber, and the intake port 22 and the exhaust port.

The engine 10 includes a valve mechanism that drives to open and close the intake valve and the exhaust valve, and as illustrated in FIG. 6, the engine 10 of the embodiment includes a camshaft 26 that drives the valve mechanism adjacent to the right side of the crankshaft 11. The camshaft 26 is rotatably supported on the engine case 12 parallel to the crankshaft 11, that is, so as to orient the vertical direction. In the valve mechanism, the cylinder head 14 includes a rocker shaft to which an intake side rocker arm and an exhaust side rocker arm are swingably journaled. The intake side rocker arm and the exhaust side rocker arm are coupled to the camshaft 26 via an intake-side cam 27 and an exhaust-side cam 28, which are disposed on the camshaft 26, and an intake-side push rod 29 and an exhaust-side push rod 30, which are driven by the intake side cam 27 and the exhaust side cam 28. On the crankshaft 11 and the camshaft 26, a drive gear 31 and a driven gear 32 are respectively mounted so as to engage with one another. The camshaft 26 is rotatably driven by the driving force of the crankshaft 11 with a predetermined reduction gear ratio (½ in this example). The rotation of the camshaft 26 synchronizes the intake valve and the exhaust valve with the crankshaft 11 via the above-described cam/push rod coupling to open and close the intake valve and the exhaust valve at a predetermined timing.

Next, as illustrated in FIG. 7, the engine starting device includes a flywheel 33 coaxially mounted on an upper end side of the crankshaft 11. The flywheel 33 and the crankshaft 11 integrally rotate. The flywheel 33 is housed in a thin cylindrical-shaped flywheel cover 34 illustrated in such as FIG. 2. The flywheel cover 34 is mounted to be secured to the engine main body side. The flywheel 33 is integrally coupled with a fan 35, and the flywheel 33 and the fan 35 integrally rotate. The flywheel cover 34 includes the recoil starter 18 that biases to rotate the crankshaft 11 for the start of the engine 10 above the crankshaft 11. The flywheel cover 34 is disposed to extend to above the fan 35 so as to house the recoil starter 18.

The recoil starter 18 includes a circular-shaped reel 36 housed to be rotatably supported in the flywheel cover 34. The reel 36 is coupled to the flywheel 33 side via a one-way clutch. That is, the reel 36 transmits a torque only in a direction that biases to rotate the crankshaft 11 for the start of the engine 10. The reel 36 is wound around with a rope for biasing to rotate. One end of the rope is secured to the reel 36, and the other end of the rope is coupled to a grip 37 on an outside of the flywheel cover 34. The reel 36 is biased by a recoil spring (not illustrated) in a winding direction of the rope for biasing to rotate. Pulling the rope with the grip 37 against an elastic force of the recoil spring drives the recoil starter 18.

Figure 8:
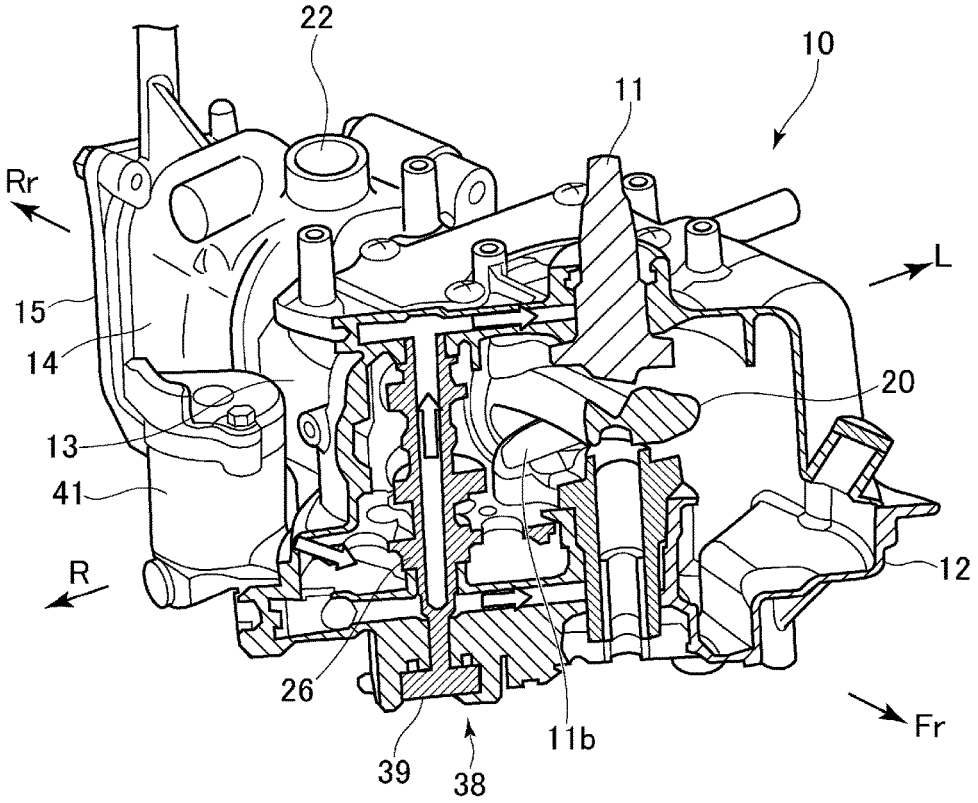
FIG. 8 is a cross-sectional view illustrating such as a lubricating system of the engine of the outboard motor according to the present invention.

Next, in the lubricating system, the engine 10 includes a lubricating device that lubricates around the crankshaft 11 and the camshaft 26, around the bearings of the crankshaft 11 and the camshaft 26, and similar parts. The lubricating device of the embodiment includes an oil pump 38 that uses the crankshaft 11, directly the camshaft 26, as a driving source to operate (see FIG. 6) As the oil pump 38, for example, a trochoid pump is employed. In this example, as illustrated in FIG. 8, the oil pump 38 is coupled to be mounted on a lower end portion of the camshaft 26. In this case, a rotor (inner rotor) 39 of the oil pump 38 is pivotably supported to the lower end portion of the camshaft 26. In the oil pump 38, a part of the lower engine case constitutes a pump casing where the rotor (inner rotor and outer rotor) 39 is rotatably housed, and the rotation of the camshaft 26 drives the oil pump 38. The pump casing is covered with a pump cover 40. The engine 10 includes a lubricating oil passage that supplies the lubricating oil on an appropriate position, and the lubricating oil is supplied to the units of the engine 10 that requires to be lubricated passing through the lubricating oil passage as arrows in FIG. 8 by the oil pump 38 constituting the lubricating device.

In the lubricating system, as illustrated in such as FIG. 6 or FIG. 8, the engine 10 includes an oil filter 41 that cleans the lubricating oil supplied from the oil pump 38. The oil filter 41 is disposed on a side portion of one side of the cylinder block 13 in the width direction, in this example, on the right side portion in the width direction, in the cylinder head J4 side. The oil pump 38 and the oil filter 41 are communicated with one another via a lubricating oil passage, and the lubricating oil discharged by the oil pump 38 is supplied to the oil filter 41 passing through the lubricating oil passage. The lubricating oil cleaned by the oil filter 41 is pumped to each unit that requires to be lubricated passing through the lubricating oil passage in the lubricating system.

Further, in the fuel supply device, as illustrated in FIG. 2 to FIG. 5, the engine 10 includes a fuel tank 17 that is housed in the exterior cover 111 as the engine cover, and the fuel tank 17 includes a fuel inlet covered with a fuel cap 42 on an upper portion. As illustrated in such as FIG. 5, the fuel tank 17 and the throttle body 23 are coupled to one another by a fuel pipe 43. As illustrated in FIG. 4, on a coupling portion of the fuel pipe 43 on the throttle body 23, a fuel injector 44 is disposed. Thus, the outboard motor 100 is an outboard motor with a built-in fuel tank.

The fuel cap 42 may be disposed on an inside of the exterior cover 111 so as not to be exposed on an outside of the exterior cover 111 (see FIG. 1). Otherwise, the fuel cap 42 may be configured such that the fuel cap 42 itself is exposed outside the exterior cover 111 and the fuel inlet is opened and closed from the outside while the exterior cover 111 is attached.

In the engine 10 of the outboard motor 100 configured as described above, especially, the cylinder axis line z of the cylinder block 13 and the cylinder head 14 of the engine 10 is disposed inclining to one side in the lateral direction (right side, in this example) with respect to the center line C extending in the front-rear direction of the outboard motor 100 from the top view as illustrated in FIG. 5, and the fuel tank 17 is disposed on the side portion of the cylinder block 13 and the cylinder head 14 in the other side in the lateral direction (left side, in this example) with respect to the center line C.

Thus disposing the cylinder block 13 and the cylinder head 14 inclining to one side in the lateral direction aggregates a space to be formed between both right and left sides of the cylinder block 13 and the cylinder head 14, and the exterior cover 111 on the opposite side in the lateral direction. Then, disposing the fuel tank 17 on the aggregated space achieves a compact configuration of the outboard motor 100. Further, the fuel tank 17 can be formed in a not-flat shape in the vertical direction, that is, a vertically elongated shape in the vertical direction. This prevents an oil supply failure caused by deviation of the fuel.

As illustrated in FIG. 7, while the exhaust port 24 is disposed on an inferior surface of the cylinder head 14 to be coupled with the exhaust passage 25 below, the intake port 22 is disposed on the top surface or the cylinder head 14 (FIG. 6) such that the throttle body 23 coupled to the intake port 22 is disposed above the cylinder head 14. Thus disposing the throttle body 23 on the intake port 22 on the top surface of the cylinder head 14 prevents such as the throttle body 23 from projecting out to the side portion of the cylinder head 14. This further expands the space in the side portion on the opposite side to the inclined direction of the cylinder block 13 and the cylinder head 14. Accordingly, the capacity of the fuel tank 17 disposed on the space can be ensured larger.

Figure 9:
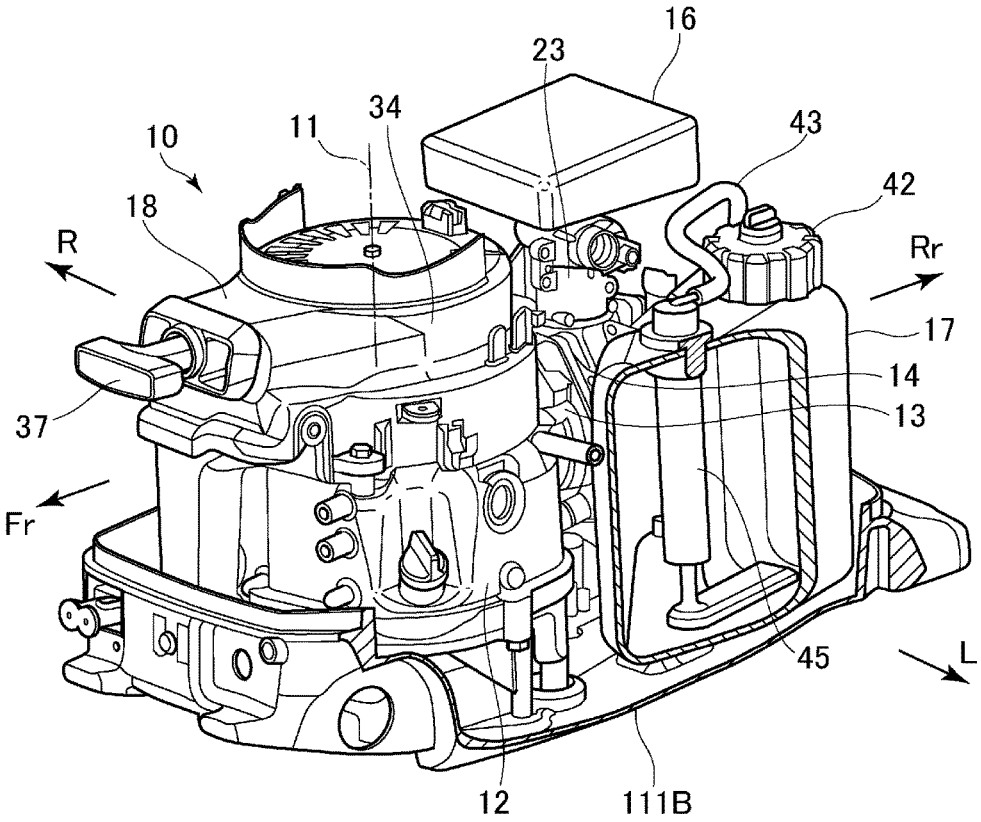
FIG. 9 is a partially broken perspective view illustrating such as around a fuel tank of the engine of the outboard motor according to the present invention.

As illustrated in FIG. 5, the fuel injector 44 is disposed near the intake port 22 of the cylinder head 14. As illustrated in FIG. 9, an in-tank type high-pressure fuel pump 45 is internally disposed on the fuel tank 17. The high-pressure fuel pump 45 and the fuel injector 44 are coupled to one another via the fuel pipe 43.

Disposing the fuel tank 17 near the intake port 22 adjacent to which the fuel injector 44 is mounted reduces a distance between the high-pressure fuel pump 45 and the fuel injector 44 in the fuel tank 17. This shortens the length of the fuel pipe 43 that couples the fuel injector 44 to the high-pressure fuel pump 45 to achieve an immediate boost of the fuel supplied to the fuel injector 44. Then, the starting ability of the engine 10 is substantially improved.

As illustrated in FIG. 6, the engine 10 includes the OHV valve mechanism, and the camshaft 26 of the valve mechanism is disposed in the engine case 12 on the one side in the lateral direction (right side, in this example) where the cylinder block 13 and the cylinder head 14 are disposed to be inclined.

Disposing the camshaft 26 on the inclined direction side of the cylinder block 13 and the cylinder head 14 prevents the engine case 12 from projecting to the side of the space where the fuel tank 17 is disposed caused by the location of the camshaft 26. Accordingly, this effectively increases the capacity of the fuel tank 17.

As illustrated in FIG. 5 or FIG. 6, the engine 10 employs the forced lubrication system that includes the oil pump 38, and the oil filter 41 that cleans the lubricating oil supplied from the oil pump 38 is disposed on the side portion of the base end of the cylinder block 13 in the one side in the lateral direction (right side, in this example) of the cylinder block 3 and the cylinder head 14.

Disposing the oil pump 38 and the oil filter 41 included in the lubricating system on the inclined direction side of the cylinder block 13 and the cylinder head 14 largely ensures the arrangement space for the fuel tank 17 on the opposite side. This increases the capacity of the fuel tank 17. Additionally, such disposal prevents the fuel in the fuel tank 17 from being heated by radiant heat of the oil filter 41 where the temperature is increased by the lubricating oil. This reduces the generation of volatile gas of the fuel.

While the present invention has been described using various embodiments above, the present invention is not limited only to these embodiments. Changes and similar modification are possible within the scope of the present invention.

For example, the inclined direction of the cylinder block 13 and the cylinder head 14 and the arrangement space for the fuel tank 17 may be disposed in a positional relationship of left-right reversal to the above description.

While the example of the outboard motor is described as the embodiment of the present invention, the present invention is effectively applicable to a case of equipment or a device that includes a crankshaft located in the vertical direction.

According to the present invention, disposing the cylinder and the cylinder head of the engine inclining to one side in the lateral direction aggregates a space to be formed between both right and left sides of the cylinder and the cylinder head, and the exterior cover on the opposite side in the lateral direction. Disposing the fuel tank on the aggregated space achieves a compact configuration of the outboard motor. Further, the fuel tank can be formed in a vertically elongated shape, not-flat shape in the vertical direction. This prevents an oil supply failure caused by deviation of the fuel.

What is claimed is:

1. An outboard motor, comprising:

a four-stroke engine that includes a crankshaft disposed in a vertical direction, a cylinder extending rearward and perpendicularly to the crankshaft as viewed from a side of the outboard motor, a cylinder head including a combustion chamber matching the cylinder, an intake port disposed on a top surface of the cylinder head, and a throttle body that attaches to a top of the intake port;

an engine cover that covers the four-stroke engine and that is dividable in a vertical direction into an upper cover and a lower cover; and a vertically elongated fuel tank that is housed inside the engine cover and has a fuel inlet on an upper portion of the vertically elongated fuel tank; wherein an axis line of the cylinder and the cylinder head of the four-stroke engine is inclined to one side in a lateral direction as viewed from top with respect to a center line extending in a front-rear direction of the outboard motor, the fuel tank is disposed next to the cylinder and the cylinder head and entirely on another side opposite from the one side with respect to the center line in a second lateral direction that is opposite to the lateral direction with respect to the center line, and the outboard motor further includes a fuel pipe that connects an upper portion of an in-tank type high-pressure fuel pump disposed inside the vertically elongated fuel tank with a fuel injector attached to the throttle body.

2. The outboard motor with a built-in fuel tank according to claim 1, wherein the four-stroke engine includes an OHV valve mechanism, and a camshaft of the OHV valve mechanism is disposed in a crankcase on the one side in the lateral direction where the cylinder and the cylinder head are disposed inclined.

3. The outboard motor with a built-in fuel tank according to claim 1, wherein the four-stroke engine includes an oil pump, and an oil filter that cleans lubricating oil supplied from the oil pump is disposed next to a base end of the cylinder on the one side in the lateral direction of the cylinder and the cylinder head for forced lubrication.

* * * * *